US011609519B2

(12) United States Patent
Nishimura

(10) Patent No.: US 11,609,519 B2
(45) Date of Patent: Mar. 21, 2023

(54) IMAGE HEATING DEVICE AND IMAGE FORMING APPARATUS

(71) Applicant: Canon Kabushiki Kaisha, Tokyo (JP)

(72) Inventor: Shizuma Nishimura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/557,384

(22) Filed: Dec. 21, 2021

(65) Prior Publication Data

US 2022/0206416 A1 Jun. 30, 2022

(30) Foreign Application Priority Data

Dec. 25, 2020 (JP) ..... JP2020-217256

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

| | | | | |
|---|---|---|---|---|
| 10,649,376 | B2 | 5/2020 | Jota et al. | |
| 11,079,705 | B2 | 8/2021 | Shimura | |
| 2018/0032008 | A1* | 2/2018 | Sako | G03G 15/2039 |
| 2019/0324389 | A1* | 10/2019 | Jota | G03G 15/2039 |

FOREIGN PATENT DOCUMENTS

| | | | |
|---|---|---|---|
| JP | 07181831 | A | 7/1995 |
| JP | 2014059508 | A | 4/2014 |
| JP | 2015064548 | A | 4/2015 |
| JP | 2019191245 | A | 10/2019 |

* cited by examiner

*Primary Examiner* — Clayton E. LaBalle
*Assistant Examiner* — Michael A Harrison
(74) *Attorney, Agent, or Firm* — Venable LLP

(57) ABSTRACT

An image heating device heats up an image formed on a recording material, the device having: a heating member provided with a heater having a plurality of heating elements juxtaposed in a direction perpendicular to a conveyance direction of the recording material; a roller, such that the circumference of the roller increases from a central portion towards ends portions, in a direction perpendicular to the conveyance direction; and a control portion that controls individually the power supplied to the plurality of heating elements. The control portion sets a control target temperature, being set in order to supply power to a heating element corresponding to a non-sheet passing area, from among the plurality of heating elements, to be higher than a lowest control target temperature from among control target temperatures that are set in order to supply power to a heating element corresponding to a sheet passing area.

10 Claims, 9 Drawing Sheets

<CLASSIFICATION BASED ON RECORDING MATERIAL INFORMATION AND IMAGE INFORMATION>

| A1 | A2 | A3 | A4 | A5 | A6 | A7 |
|---|---|---|---|---|---|---|
| AN | AP | AI | AI | AI | AP | AN |

FIG. 3A
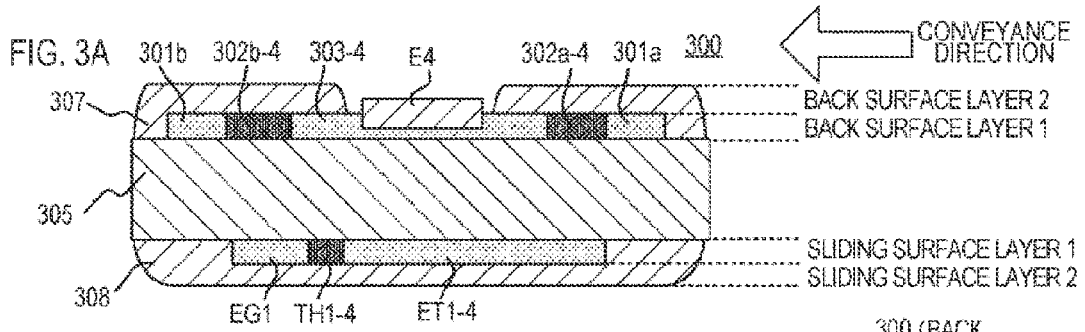
FIG. 3B
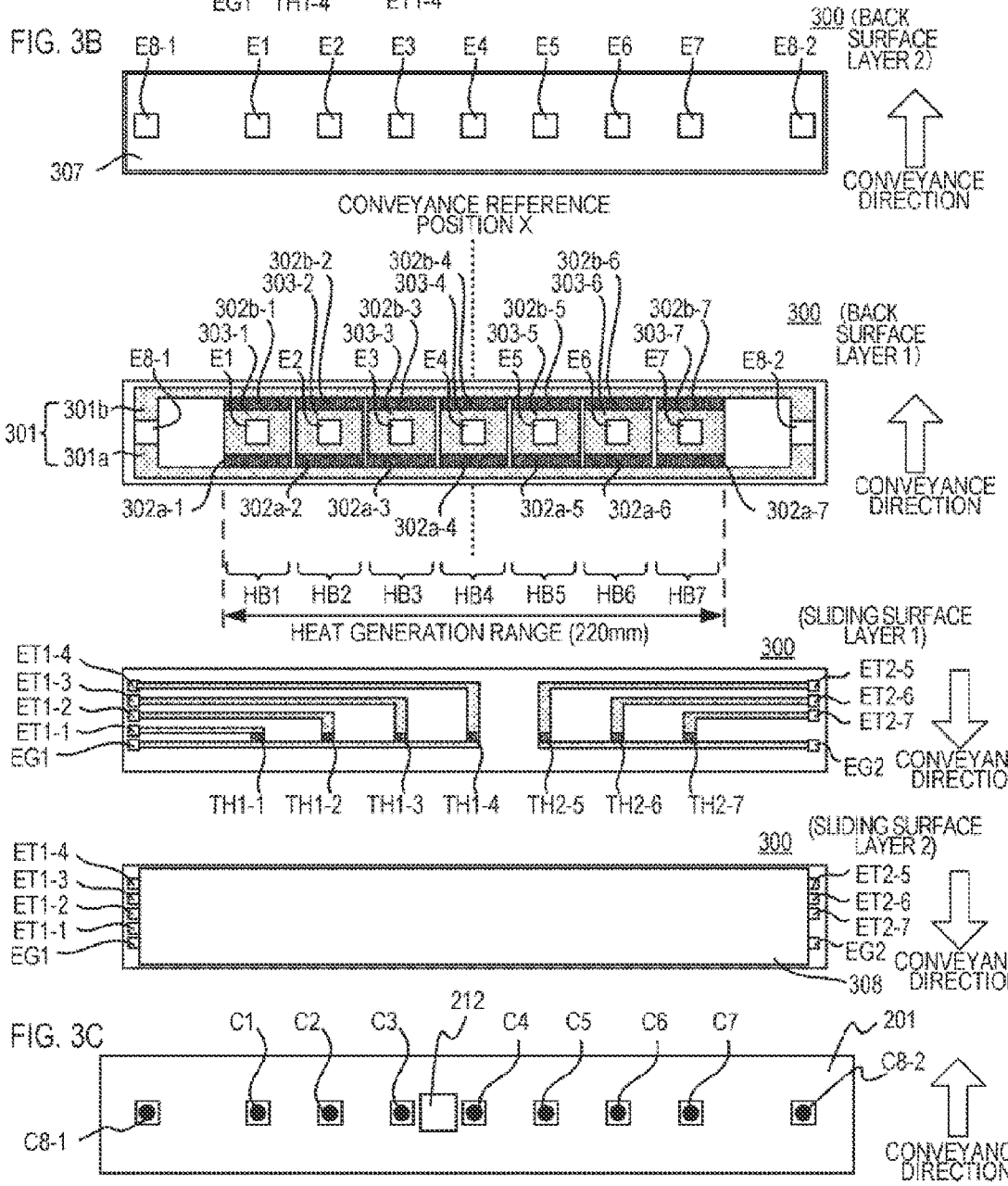
FIG. 3C

FIG. 6B <CLASSIFICATION BASED ON RECORDING MATERIAL INFORMATION AND IMAGE INFORMATION>

| A1 | A2 | A3 | A4 | A5 | A6 | A7 |
|---|---|---|---|---|---|---|
| AN | AP | AI | AI | AI | AP | AN |

IMAGE HEATING DEVICE AND IMAGE FORMING APPARATUS

BACKGROUND OF THE INVENTION

Field of the Invention

The present invention relates to an image forming apparatus such as a printer, a copier or the like that relies on an electrophotographic system. The present invention also relates to an image heating device such as a fixing unit mounted on an image forming apparatus, or a gloss imparting device for increasing the gloss value of toner fixed on a recording material, through re-heating of the toner image.

Description of the Related Art

Image heating devices in the form of fixing units or gloss imparting devices used in an electrophotographic image forming apparatuses, such as copiers or printers, include film heating-type image heating devices that are excellent in power saving. Schemes have also been proposed (Japanese Patent Application Publication No. 2014-059508), in such image heating devices, that involve selectively heating an image portion formed on a recording material. In such a method, each heating element is selectively heat-controlled depending on the presence or absence of an image on the recording material, such that the energization of the heating element is reduced in portions where there is no image on the recording material (hereafter non-image portions), to thereby further reduce power consumption.

SUMMARY OF THE INVENTION

A pressure roller in the image heating device may in some instances have a so-called concave crown shape. The term concave crown shape denotes herein a shape such that the outer diameter of the pressure roller increases gradually from a central portion towards end portions. By resorting to such a scheme, the recording material is conveyed relatively quickly from the central portion towards the end portions, thereby suppressing the occurrence of wrinkles in the recording material. In a case however where an image portion formed on a recording material is selectively heated, as in Japanese Patent Application Publication No. 2014-059508, thermal expansion of the pressure roller is larger at the end portions than at the central portion, since the image is mainly drawn at the center of the recording material, and thus the wrinkle suppression effect on the recording material, elicited by the above-described concave crown shape, is weak. This occurrence has become noticeable in the wake of ever higher speeds of image forming apparatuses in recent years. Moreover it has been found that making a fixing film thinner may lead, in extreme cases, to buckling breakage of the fixing film.

It is an object of the present invention to provide a technique that allows suppressing the occurrence of wrinkles in a recording material, and also saving power.

To attain the above object, an image heating device of the present invention that heats up an image formed on a recording material, with heat from a heater, has:

a heating member provided with a heater having a plurality of heating elements juxtaposed in a direction perpendicular to a conveyance direction of a recording material;

a roller that forms a nip portion by pressing against the heating member and that rotates, such that the circumference of the roller increases from a central portion towards ends portions, in a direction perpendicular to the conveyance direction; and a control portion that controls individually the power supplied to the plurality of heating elements;

wherein the image heating device heats up an image formed on the recording material, with heat from the heater; and wherein the control portion sets a control target temperature, being set in order to supply power to a heating element corresponding to a non-sheet passing area through which the recording material does not pass at the nip portion, from among the plurality of heating elements, to be higher than a lowest control target temperature from among control target temperatures that are set in order to supply power to a heating element corresponding to a sheet passing area through which the recording material passes at the nip portion.

The present invention allows suppressing the occurrence of wrinkles while preserving power savings.

Further features of the present invention will become apparent from the following description of exemplary embodiments with reference to the attached drawings.

BRIEF DESCRIPTION OF THE DRAWINGS

FIGS. 3A to 3C are heater configuration diagrams of the present invention;

FIGS. 6A and 6B are concrete examples of classification of heating areas in the present invention:

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

1. Overall Structure of the Image Forming Apparatus

Figure 1:
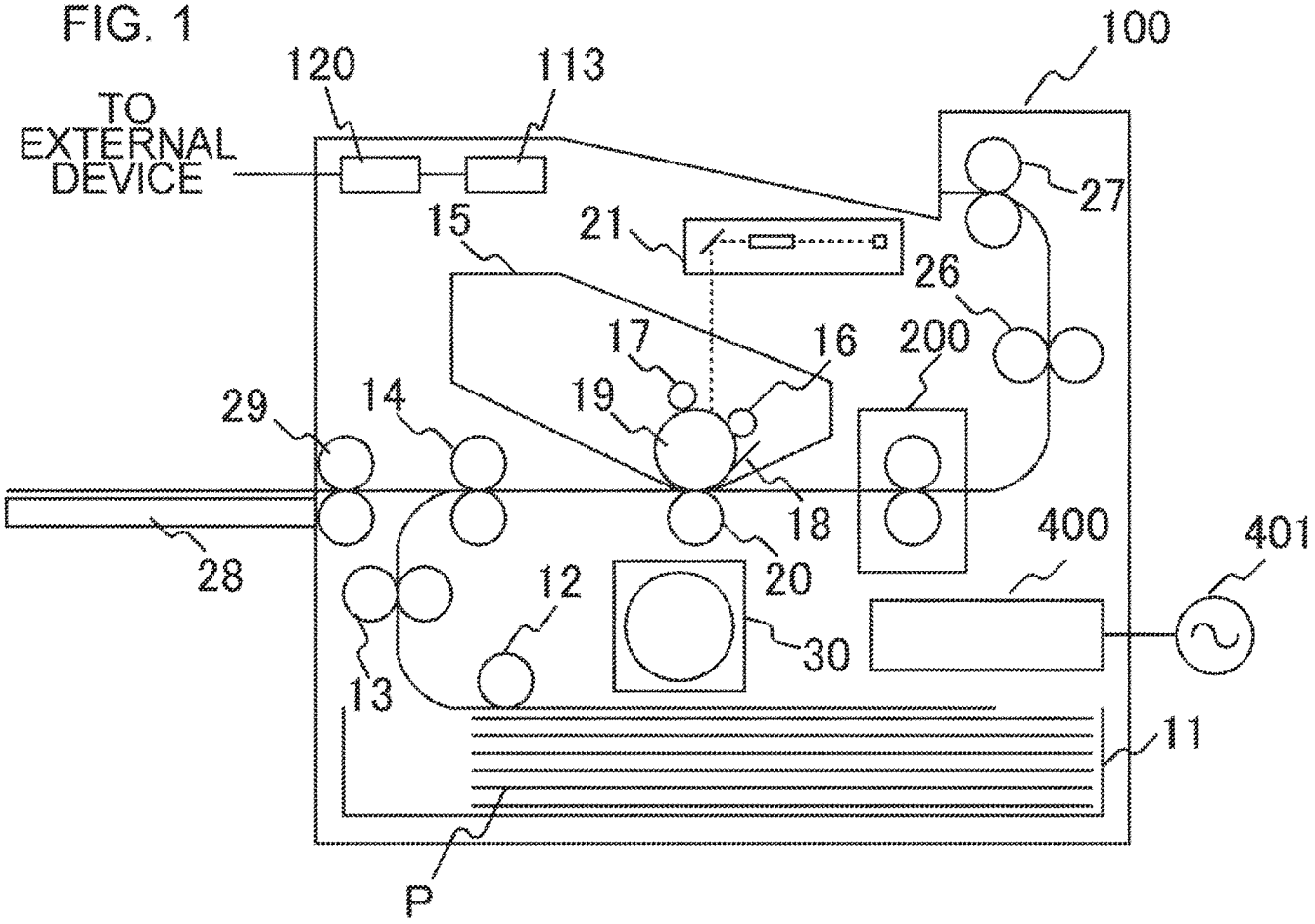
FIG. 1 is a schematic cross-sectional diagram of an image forming apparatus according to an embodiment of the present invention.

FIG. 1 is a schematic front-view cross-sectional diagram of an image forming apparatus. Embodiments of image forming apparatuses to which the present invention can be applied include electrophotographic systems, as well as copiers, printers and the like that utilize an electrostatic recording system. An instance will be explained herein in which the present invention is applied to a laser printer in which images are formed on a recording material P, by resorting to an electrophotographic system.

An image forming apparatus 100 is provided with a video controller 120 and a control portion 113. As an acquisition portion that acquires image information to be formed on a recording material, the video controller 120 receives and processes image information and print instructions transmitted from an external device such as a personal computer. The control portion 113, which is connected to the video controller 120, controls each portion that makes up the image forming apparatus 100, in response to an instruction from the video controller 120. Upon reception, by the video controller 120, of a print instruction from an external device, image formation is carried out in accordance with the following operations.

When the image forming apparatus 100 receives a print signal, a scanner unit 21 emits laser light modulated according to image information in the received data, and the surface of a photosensitive drum 19 having been charged with a predetermined polarity is scanned by a charging roller 16. An electrostatic latent image becomes formed as a result on the photosensitive drum 19. The electrostatic latent image on the photosensitive drum 19 becomes developed in the form of a toner image through supply of toner to the electrostatic latent image from a developing roller 17. Meanwhile, the recording material (recording sheet) P loaded on a sheet feeding cassette 11 is fed sheet by sheet by a pickup roller 12, and is conveyed towards a resist roller pair 14 by a convey roller pair 13. The recording material P is conveyed from the resist roller pair 14 to a transfer position in concert with the timing at which the toner image on the photosensitive drum 19 reaches the transfer position formed at the photosensitive drum 19 and the transfer roller 20. The toner image on the photosensitive drum 19 is transferred to the recording material P, as the recording material P passes the transfer position. Thereafter, the recording material P is heated by a fixing apparatus (fixing portion) 200 as an image heating device (image heating portion), whereupon the toner image becomes heat-fixed to the recording material P. The recording material P carrying thus the fixed toner image is discharged onto a tray above the image forming apparatus 100 by convey rollers pair 26, 27. A drum cleaner 18 cleans the toner remaining on the photosensitive drum 19. A sheet feed tray 28 (manual feed tray), which is a pair of recording material regulation plates the width of which can be adjusted according to the size of the recording material P, is provided in order to handle also recording material P having a non-standard size. Pickup rollers 29 feed the recording material P from the sheet feed tray 28. The image forming apparatus 100 has a motor 30 that drives the fixing apparatus 200 and so forth. A heater driving means connected to a commercial AC power supply 401 and a control circuit 400 as an energization control portion supply power to the fixing apparatus 200. The photosensitive drum 19, the charging roller 16, the scanner unit 21, the developing roller 17, and the transfer roller 20 described above constitute an image forming portion at which an unfixed image is formed on the recording material P. In the present embodiment a developing unit having the photosensitive drum 19, the charging roller 16 and the developing roller 17, and a cleaning unit having the drum cleaner 18 are configured to be detachable, in the form of a process cartridge 15, from the apparatus body of the image forming apparatus 100.

The image forming apparatus 100 of the present embodiment has a maximum sheet passage width of 216 mm in a direction perpendicular to the conveyance direction of the recording material P, and is capable of printing 60 prints of A4-size recording material P per minute, i.e. at a conveyance speed of 300 mm/sec.

2. Configuration of the Image Heating Device

Figure 2:
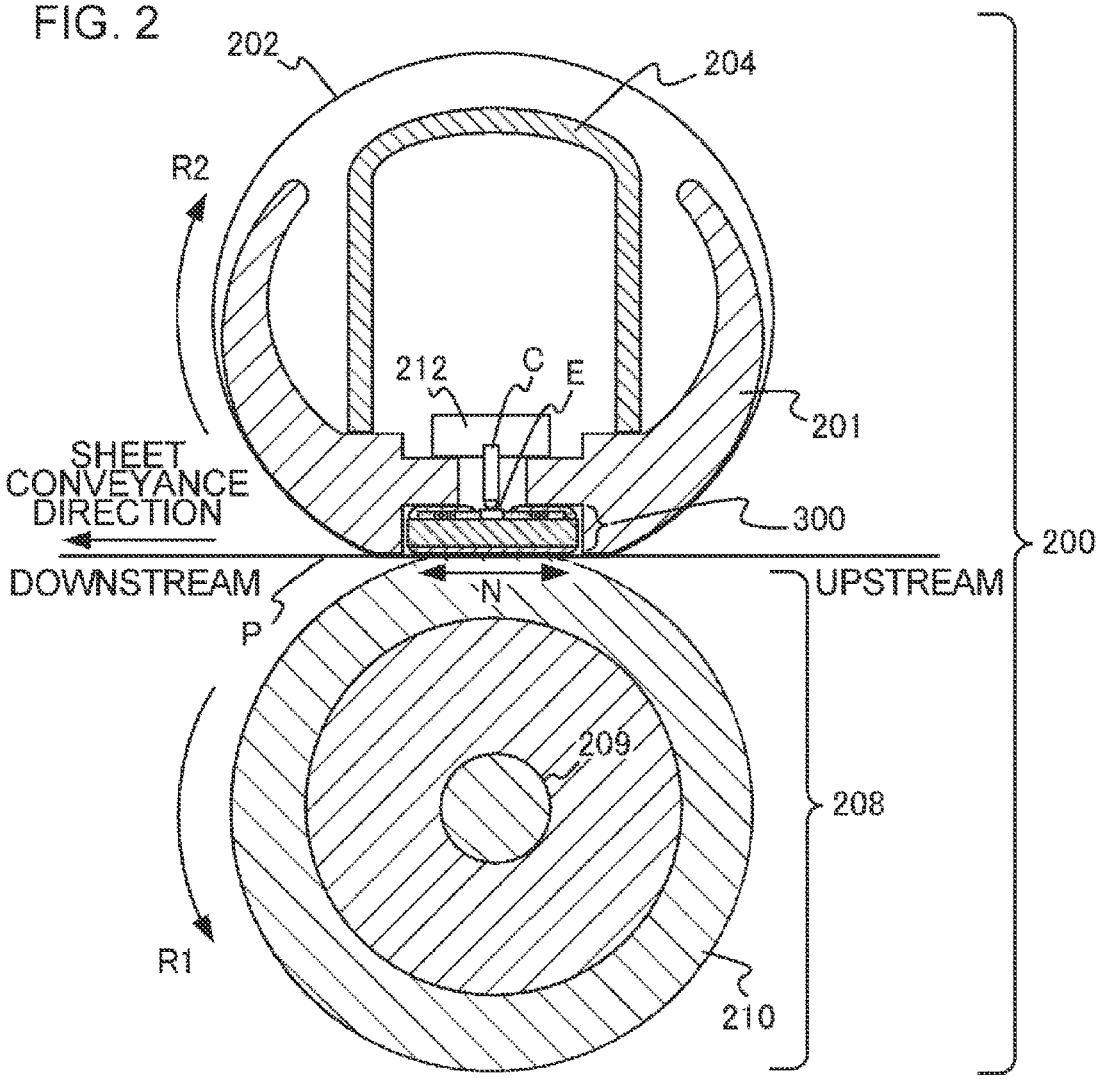
FIG. 2 is a cross-sectional diagram of a heating device of the present invention.

FIG. 2 is a schematic cross-sectional diagram of the fixing apparatus 200 as the image heating device of the present embodiment. The fixing apparatus 200 has a fixing film 202 in the form of an endless belt, a heater 300 that comes in contact with the inner surface of the fixing film 202, a pressure roller 208 that presses against the heater 300 across the fixing film 202, and a metal stay 204. A fixing nip portion N is formed through pressing of the pressure roller 208 against the outer surface of the fixing film 202. The fixing film 202, the heater 300 and various structures disposed inward of the fixing film 202 in the present embodiment correspond to the heating member of the present invention.

The fixing film 202 is a multi-layer heat-resistant film formed to a tubular shape, and has a base layer of a heat-resistant resin such as polyimide, or a metal such as stainless steel. In order to prevent adhesion of toner and ensure separability from the recording material P, a release layer is formed on the surface of the fixing film 202 by coating the surface with a heat-resistant resin of superior releasability such as a tetrafluoroethylene-perfluoroalkyl vinyl ether copolymer (PFA). In apparatuses for forming color images, in particular, a heat-resistant rubber such as silicone rubber may be formed, as an elastic layer, between the base layer and the release layer, for the purpose of improving image quality. In the present embodiment the fixing film 202 had an outer diameter of 24 mm, the base layer was formed of polyimide to a thickness of 70 μm, the elastic layer was formed of silicone rubber to a thickness of 200 μm, and the release layer was formed of PFA to a thickness of 15 μm.

The pressure roller 208 has a core metal 209 of a material such as iron, SUS or aluminum, and an elastic layer 210 of a material such as silicone rubber. With a view to preventing adhesion of toner, a release layer 211 is formed on the surface of the pressure roller 208 through coating with a heat-resistant resin of superior releasability such as a tetrafluoroethylene-perfluoroalkyl vinyl ether copolymer (PFA). In the present embodiment, the outer diameter of the pressure roller 208 is 25 mm at a central portion of smallest diameter (minimum circumference), and increases gradually towards both end portions, to a largest diameter (maximum peripheral circumference) of 25.16 mm. That is, the pressure roller 208 of the present embodiment has a so-called concave crown shape. A difference in peripheral speed arises between the central portion and both end portions of the pressure roller 208, on account of such a shape, and as a result the recording material P nipped in the fixing nip portion N is acted upon by moderate tension, form the central portion in a longitudinal direction perpendicular to the conveyance direction of the recording material P, towards both end portions. The occurrence of wrinkles in the recording material P can be suppressed and the conveyance property of the recording material P at the fixing nip portion N can be stabilized, through application of forces that stretch the recording material P from the center of in the longitudinal direction towards the ends. The core metal 209 is formed of SUS, and has a constant outer diameter of 17 mm. The elastic layer 210 formed on the outer periphery of the core metal 209 is formed of silicone rubber and has a thickness of 4 mm, at the central portion, that gradually increases towards both end portions, reaching a value of 4.08 mm at both end portions. That is, the pressure roller 208 is formed to a concave crown shape on account of the varying layer thickness of the elastic layer 210 in the axial direction. The release layer 211 formed on the surface of the elastic layer 210 was formed herein of PFA and had a thickness of 20 μm.

The degree of the concave crown shape of the pressure roller 208 is defined as a concave crown amount, as follows.

(Concave crown amount)=(outer diameter of the pressure roller 208 at both end portions)−(outer diameter of the pressure roller 208 at the central portion)

The pressure roller 208 expands and deforms on account of heat from the heater 300; herein the concave crown amount tends to increase as heating progresses, given the ease with which temperature rises in particular at both end portions in the longitudinal direction. Control for keeping low the control temperature at the end portions of the fixing nip portion N may be resorted to, from the viewpoint of suppressing the adverse effects of a rise in temperature at the end portions, or in terms of saving energy. As a result of such control, heating at the end portions of the of the pressure roller 208 is suppressed, and the concave crown amount necessary for ensuring the conveyance property of the recording material may in some instances fail to be secured.

The heater 300 is held in a heater holding member 201 made of a heat-resistant resin, such that the fixing film 202 is heated through heating of heating areas $A_1$ to $A_7$ (described in detail below) provided within the fixing nip portion N. The heater holding member 201 also has a guiding function of guiding the rotation of the fixing film 202. Electrodes E are provided on the heater 300, on the reverse side from that of the fixing nip portion N, with power being supplied to the electrodes E through an electrical contacts C. The metal stay 204 receives a pressing force, not shown, and urges thereby the heater holding member 201 towards the pressure roller 208. The pressure roller 208 presses as a result against the fixing film 202 as a part of the heating member, to thereby form the fixing nip portion. A safety element 212 such as a thermo-switch or thermal fuse that cuts off the supply of power to the heater 300 when triggered by abnormal heat generated by the heater 300, comes in contact with the heater 300, directly or indirectly via the heater holding member 201. The heater 300, the heater holding member 201 and the metal stay 204 constitute a heater unit 311. Another member such as a heat transfer member may be interposed between the fixing film 202 and the heater 300.

The pressure roller 208 receives power from the motor 30, and rotates in the direction of arrow R1. The fixing film 202 is driven so as to rotate in the direction of arrow R2, on account of the rotation of the pressure roller 208. The unfixed toner image on the recording material P is fixed through application of heat to the fixing film 202 while the recording material P is nipped and conveyed at the fixing nip portion N. In order to secure slidability of the fixing film 202 and achieve a stable driven rotation state, a highly heat-resistant sliding grease is interposed between the heater 300 and the fixing film 202.

3. Configuration of the Heater

The configuration of the heater 300 in the present embodiment will be explained with reference to FIGS. 3A to 3C. FIG. 3A is a cross-sectional diagram of the heater 300, FIG. 3B is a plan-view diagram of the layers of the heater 300, and FIG. 3C is a diagram for explaining a method for connecting electrical contacts C to the heater 300. FIG. 3B illustrates a conveyance reference position X of the recording material P in the image forming apparatus 100 of the present embodiment. The term conveyance reference in the present embodiment is a center reference, with the recording material P being conveyed so that a center line thereof in a direction perpendicular to the conveyance direction runs along the conveyance reference position X. FIG. 3A is a cross-sectional diagram of the heater 300 at the conveyance reference position X.

The heater 300 is made up of a ceramic substrate 305, a back surface layer 1 provided on the substrate 305, a back surface layer 2 that covers the back surface layer 1, a sliding surface layer 1 provided on the substrate 305, on the reverse side from that of back surface layer 1, and a sliding surface layer 2 that covers the sliding surface layer 1.

The back surface layer 1 has a conductor 301 (301*a*. 301*b*) provided along the longitudinal direction of the heater 300. The conductor 301 is separated into a conductor 301*a* and a conductor 301*b*, the conductor 301*b* being arranged downstream of the conductor 301*a* in the conveyance direction of the recording material P. Further, the back surface layer 1 has conductors 303 (303-1 to 303-7) provided in parallel with the conductors 301*a*, 301*b*. The conductors 303 are provided between the conductor 301*a* and the conductor 301*b* in the longitudinal direction of the heater 300.

The back surface layer 1 has heating elements 302*a* (302*a*-1 to 302*a*-7) and heating elements 302*b* (302*b*-1 to 302*b*-7), which are heat-generating resistors that generate heat through energization. The heating elements 302*a* are provided between the conductor 301*a* and the conductors 303, and generate heat through supply of power via the conductor 301*a* and the conductors 303. The heating elements 302*b* are provided between the conductor 301*b* and the conductors 303, and generate heat through supply of power via the conductor 301*b* and the conductors 303.

A heat generating portion made up of the conductor 301, the conductors 303, the heating elements 302*a*, and the heating elements 302*b*, is divided into seven heat generation blocks ($HB_1$ to $HB_7$) in the longitudinal direction of the heater 300. That is, the heating elements 302*a* are divided into seven regions of heating elements 302*a*-1 to 302*a*-7 in the longitudinal direction of the heater 300. Further, the heating elements 302*b* are divided into seven regions of heating elements 302*b*-1 to 302*b*-7 in the longitudinal direction of the heater 300. The conductors 303 are divided into seven regions of conductors 303-1 to 303-7 according to the division positions of the heating elements 302*a*, 302*b*. Each of the seven heat generation blocks ($HB_1$ to $HB_7$) is individually controlled through control of the amount of energization of a heat-generating resistor in each block.

The heat generation range in the present embodiment is the range from the left end of the heat generation block $HB_1$ in the figure to the right end of the heat generation block $HB_7$ in the figure, to a total length of 220 mm. Herein the length of each heat generation block in the longitudinal direction is the same, of about 31 mm, but the length of the blocks may be dissimilar.

The back surface layer 1 has electrodes E (E1 to E7, plus E8-1 and E8-2).

The electrodes E1 to E7, which are provided in the regions of the conductors 303-1 to 303-7, respectively, are electrodes for supplying power to the heat generation blocks $HB_1$ to $HB_7$, respectively, via the conductors 303-1 to 303-7. The electrodes E8-1, E8-2 are provided at the end of the heater 300 in the longitudinal direction, so as to be connected to the conductors 301, and are electrodes for supplying power to the heat generation blocks $HB_1$ to $HB_7$ via the conductors 301. In the present embodiment the electrodes E8-1, E8-2 are provided at both ends of the heater 300 in the longitudinal direction, but for instance there may be provided just the electrode E8-1 on one side. Power is supplied to the conductors 301*a*. 301*b* through a common electrode, but individual electrodes may be provided for each of the conductors 301*a*, 301*b*, for supply of power to the respective conductor.

The back surface layer 2 is made up of a surface protective layer 307 having insulating properties (glass in the present embodiment), and covers the conductors 301, the conductors 303, and the heating elements 302*a*, 302*b*. The surface protective layer 307 is formed except at the sites of the electrodes E, such that the electrical contacts C can be connected to the electrodes E from the back surface layer 2 side of the heater.

The sliding surface layer 1 is provided on the surface, of the substrate 305, on the reverse side from the surface on which the back surface layer 1 is provided, and has thermistors TH (TH1-1 to TH1-4, and TH2-5 to TH2-7) as a detection means for detecting the temperature of the respective heat generation blocks $HB_1$ to $HB_7$. The thermistors TH are made up of a material having PTC characteristics or NTC characteristics (NTC characteristics in the present embodiment), such that the temperature of all the heat generation blocks can be detected by detecting the resistance value of the thermistors TH.

The sliding surface layer 1 has conductors ET (ET1-1 to ET1-4 and ET2-5 to ET2-7) and conductors EG (EG1, EG2) for the purpose of energizing the thermistors TH and detecting the resistance value thereof. The conductors ET1-1 to ET1-4 are connected to the thermistors TH1-1 to TH1-4, respectively. The conductors ET2-5 to ET2-7 are connected to the thermistors TH2-5 to TH2-7, respectively. The conductor EG1 is connected to four thermistors TH1-1 to TH1-4, forming therewith a common conductive path. The conductor EG2 is connected to three thermistors TH2-5 to TH2-7, forming therewith a common conductive path. The conductors ET and the conductors EG are formed along the length of the heater 300 up to the longitudinal direction end portion thereof, and are connected to the control circuit 400 at the longitudinal direction end portion of the heater via respective electrical contacts, not shown.

The sliding surface layer 2, which is made up of a surface protective layer 308 having slidability and insulating properties (glass in the present embodiment), covers the thermistors TH, the conductors ET and the conductors EG, to secure slidability with the inner surface of the fixing film 202. The surface protective layer 308 is formed except at both longitudinal direction ends of the heater 300, for the purpose of providing electrical contacts to the conductors ET and the conductors EG.

A method for connecting the electrical contacts C to respective electrodes E will be explained next. FIG. 3C is a plan-view diagram of the manner in which the electrical contacts C are connected to respective electrodes E, as viewed from the side of the heater holding member 201. The heater holding member 201 is provided with through-holes at positions corresponding to the electrodes E (E1 to E7, plus E8-1 and E8-2). The electrical contacts C (C1 to C7, plus C8-1 and C8-2) are electrically connected to the electrodes E (E1 to E7, plus E8-1 and E8-2), at respective through-hole positions, in accordance with a method such as spring-urging or welding. The electrical contacts C are connected to the below-described control circuit 400 of the heater 300 via a conductive material, not shown, that is provided between the metal stay 204 and the heater holding member 201.

4. Configuration of the Heater Control Circuit

Figure 4:
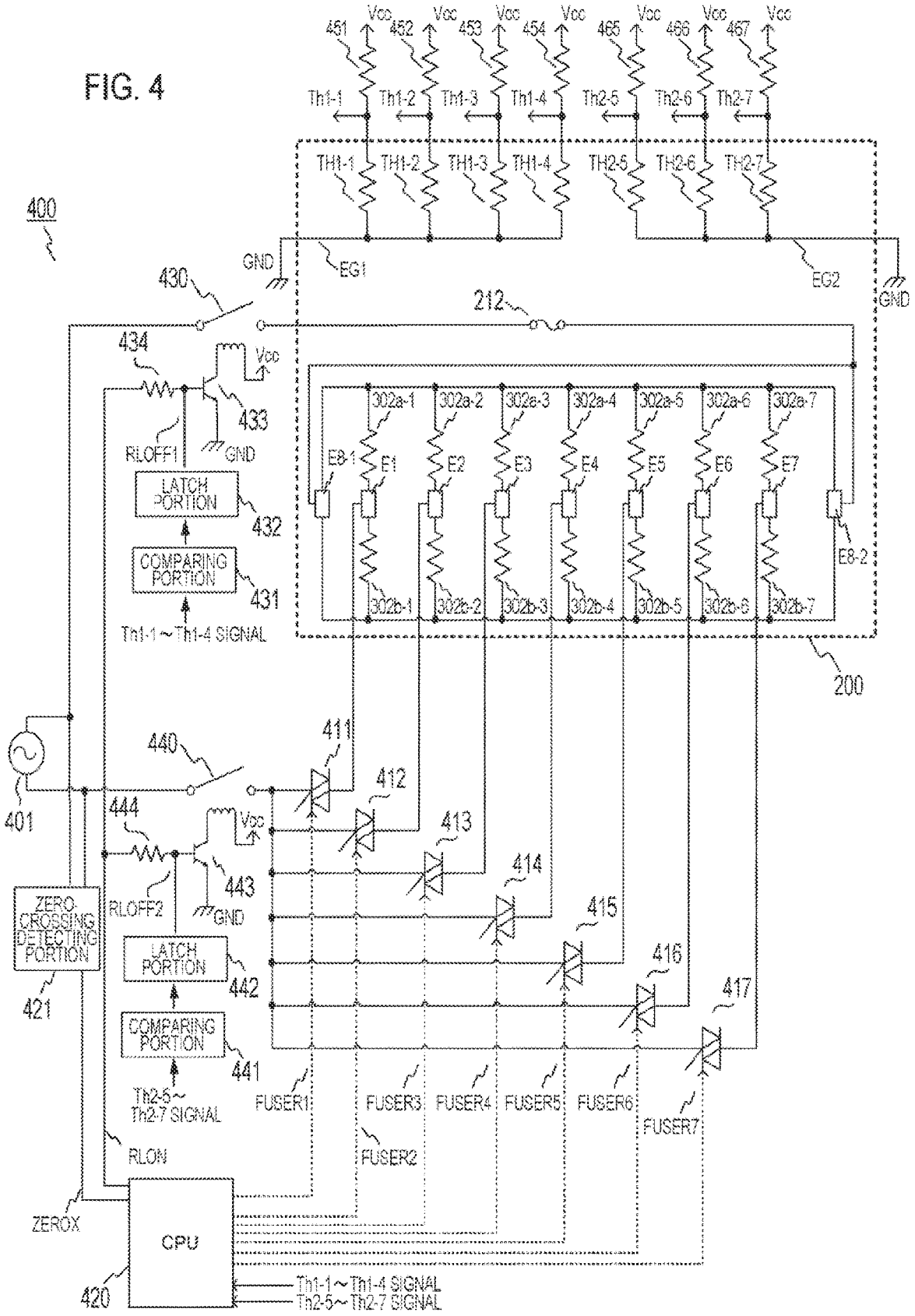
FIG. 4 is a heater control circuit diagram of the present invention.

FIG. 4 illustrates a circuit diagram of the control circuit 400 of the heater 300 of Embodiment 1. The reference symbol 401 denotes a commercial AC power supply connected to the image forming apparatus 100. Power control of the heater 300 is performed through energization/shut-off of triac 411 to triac 417. The triacs 411 to 417 operate according to respective FUSER1 to FUSER7 signals from a CPU 420. The drive circuits of the triacs 411 to 417 are not depicted. The control circuit 400 of the heater 300 has a circuit configuration whereby the seven heat generation blocks HB to $HB_7$ can be independently controlled, individually, by the seven triacs 411 to 417. A zero-crossing detecting portion 421, which is a circuit that detects the zero cross of the AC power supply 401, and outputs a ZEROX signal to the CPU 420. The ZEROX signal is used for instance in detection of the timing of phase control and wavenumber control of the triacs 411 to 417.

An explanation follows next on a temperature detection method of the heater 300. The temperature of the heater 300 is detected by the thermistors TH (TH1-1 to TH1-4, and TH2-5 to TH2-7). The divided voltage between the thermistors TH1-1 to TH1-4 and the resistors 451 to 454 is detected by the CPU 420 in the form of Th1-1 to Th1-4 signals, which are then converted to temperature in the CPU 420. Similarly, the divided voltage between the thermistors TH2-5 to TH2-7 and the resistors 465 to 467 is detected by the CPU 420 in the form of Th2-5 to Th2-7 signals, which are then converted to temperature in the CPU 420.

In the internal processing of the CPU 420, the power to be supplied is calculated for instance through PI control (proportional-integral control) on the basis of the below-described control temperature (control target temperature) $TGT_i$ of each heat generation block and on the basis of the temperature detected by each thermistor. Further, the power to be supplied is converted into a control level of a phase angle (phase control) and a wavenumber (wavenumber control) corresponding to the power, such that the triacs 411 to 417 are controlled according to these control conditions. The CPU 420, as a control portion and an acquisition portion in the present invention, executes for instance various calculations and energization control pertaining to temperature control of the heater 300.

A relay 430 and a relay 440 are used as means for cutting off power to the heater 300 in a case where the heater 300 overheats on account of a malfunction or the like. The circuit operation of the relay 430 and the relay 440 will be explained next. When a RLON signal is in a High state, a transistor 433 is turned on, a secondary coil of the relay 430 is energized from a power supply voltage Vcc, and a primary contact of the relay 430 is turned on. When the RLON signal is in a Low state, the transistor 433 is turned off the current flowing from the power supply voltage Vcc to the secondary coil of the relay 430 is cut off and the primary contact of the relay 430 is turned off. When the RLON signal is in the High state, the transistor 443 is turned on, the secondary coil of the relay 440 is energized from the power supply voltage Vcc, and the primary contact of the relay 440 is turned on. When the RLON signal is in the Low state, the transistor 443 is turned off, the current flowing from the power supply voltage Vcc to the secondary coil of the relay 440 is cut off, and the primary contact of the relay 440 is turned off. The resistor 434 and the resistor 444 are current-limiting resistors.

An explanation follows next on the operation of the safety circuit in which the relay 430 and the relay 440 are used. When any one of the detected temperatures by the thermistors TH1-1 to TH1-4 exceeds respectively set predetermined values, the comparing portion 431 operates the latch portion 432, and the latch portion 432 latches the RLOFF1 signal in the Low state. When the RLOFF1 signal is in the Low state, the transistor 433 is kept turned off, even if the RLON signal is set to the High state by the CPU 420, and accordingly the relay 430 can be kept turned off (safe state). In a non-latch state, the latch portion 432 sets the RLOFF1 signal to open-state output. Similarly, in a case where any one of the temperatures detected by the thermistors TH2-5 to TH2-7 exceeds a respectively set predetermined value, the comparing portion 441 operates the latch portion 442, and the latch portion 442 latches the RLOFF2 signal in the Low state. When the RLOFF2 signal is in the Low state, the transistor 443 is kept turned off, even if the RLON signal is set by the CPU 420 to a High state, and accordingly the relay 440 can be kept turned off (safe state). In a non-latch state, similarly, the latch portion 442 sets the RLOFF2 signal to open-state output.

5. Setting of Heating Areas

Figure 5:
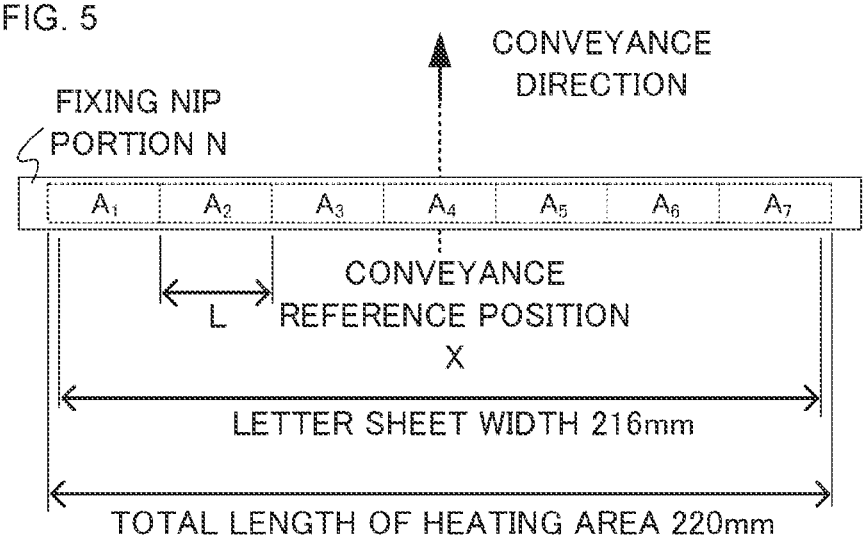
FIG. 5 is a diagram illustrating heating areas of the present invention.

FIG. 5 is a diagram illustrating heating areas $A_1$ to $A_7$ in the present embodiment, the heating areas being depicted compared with a sheet width of LETTER size sheet. The heating areas $A_1$ to $A_7$ are provided at positions corresponding to the heat generation blocks $HB_1$ to $HB_7$, within the fixing nip portion N, the heating areas $A_1$ (i=1 to 7) being heated as a result of generation of heat by respective heat generation blocks $HB_1$ (i=1 to 7). That is, the heating areas $A_1$ to $A_7$ are formed corresponding to the heat generation blocks $HB_1$ to $HB_1$ (plurality of heating elements). The total length of the heating areas $A_1$ to $A_7$ is 220 mm, each area being the result of evenly dividing this total length into seven (L=31.4 mm).

Figure 6A:
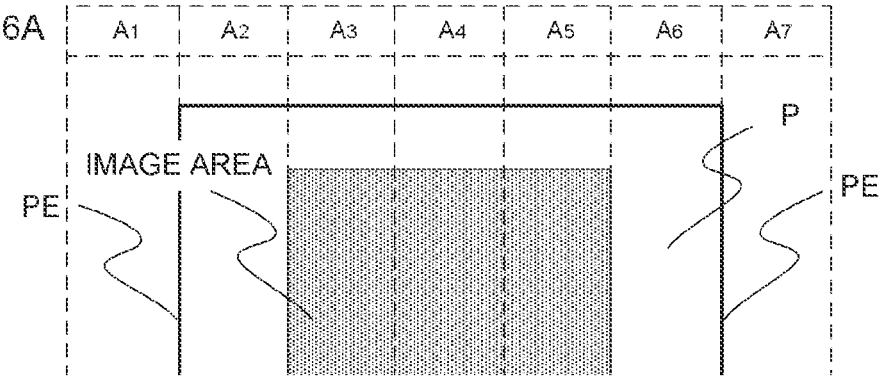

An example of the classification of the heating areas $A_1$ will be explained next with reference to FIGS. 6A and 6B. In the present example the recording material P passes through the heating area $A_2$ to the heating area $A_6$. The recording material P and an image are present at the positions illustrated in FIG. 6A. Further, the reference symbol PE denotes both edge portions of the recording material P in the longitudinal direction. FIG. 6B illustrates a classification of the heating areas $A_i$. On the basis of the image data (image information) and recording material information (recording material size), an image range (range in which an image on the recording material is present) passes through the heating areas $A_3$, $A_4$, $A_5$, and accordingly these are each classified as an image area AI. By contrast, the image range does not pass through the heating areas $A_2$, $A_6$, and accordingly these are each classified as a non-image area AP. Further, the recording material P does not pass through the heating areas $A_1$, $A_7$, and accordingly these are each classified as a non-sheet passing area AN.

6. Overview of the Heater Control Method

A heater control method of the present embodiment, i.e. a method for controlling the heat generation amount of the heat generation blocks $HB_i$ (i=1 to 7) will be explained next. The amount of heat generated by the heat generation blocks $HB_i$ is determined by the power supplied to the heat generation blocks $HB_i$. The heat generation amount of the heat generation blocks $HB_i$ increases as a result of an increase in the power supplied to the heat generation blocks $HB_i$, whereas the heat generation amount of the heat generation blocks $HB_i$ decreases as a result of reduction of the heat generation amount of the heat generation blocks $HB_i$. The power supplied to the heat generation blocks $HB_i$ is calculated on the basis of the control temperatures $TGT_i$ (i=1 to 7) selected for each heat generation block, and on the basis of the detected temperatures of the thermistors. In the present embodiment, the supplied power is calculated by PT control (proportional-integral control) so that the detected disclosure of each thermistor becomes equal to the control temperature $TGT_i$ of the respective heat generation block.

Figure 7:
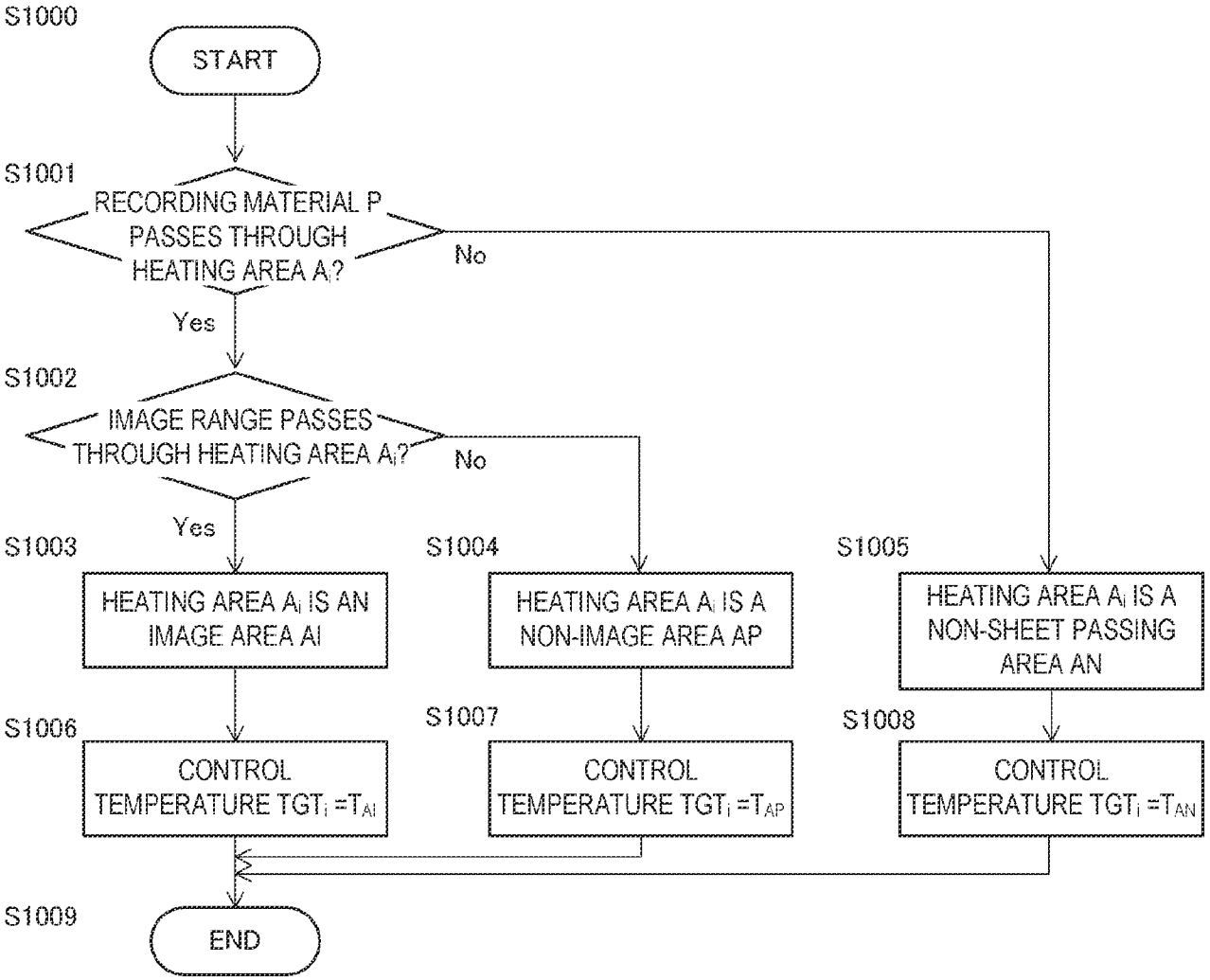
FIG. 7 is a flowchart of classification of heating areas and determination of control temperatures in the present invention.

FIG. 7 is a flowchart of the classification of the heating areas and the determination of control temperatures in the present embodiment. As illustrated in FIG. 7, the heating areas $A_i$ (i=1 to 7) are classified into an image area AI, a non-image area AP, and a non-sheet passing area AN. The heating areas $A_i$ are classified on the basis of image information (image data) and recording material information (recording material size) transmitted from an external device (not shown) such as a host computer.

Whether each heating area $A_i$ is or not a recording material range is determined from the recording material information (recording material size) (FIG. 7: S1001). In the case of the recording material range, it is determined next whether the heating area $A_i$ is an image range, on the basis of image information (image data) (FIG. 7: S1002). In the case of an image range, the heating area $A_i$ is classified as an image area AI (FIG. 7: S1003); otherwise, the heating area $A_i$ is classified as a non-image area AP (FIG. 7: S1004). In a case where the heating area $A_i$ is classified as an image area AI, the respective control temperature $TGT_1$ is set to $TGT_1=T_{AI}$ (FIG. 7: S1006). Herein, $T_{AI}$ is an image area temperature, and is set as an appropriate temperature in order to fix the unfixed image onto the recording material P. In a case where the heating area $A_i$ is classified as a non-image area AP in S1002, the respective control temperature $TGT_i$ is set to $TGT_i=T_{AP}$ (FIG. 7: S1007). Herein, $T_{AP}$ is a non-image area temperature. Through setting of the non-image area temperature $T_{AP}$ to a temperature lower than the image area temperature $T_{AI}$, the heat generation amount at a heat generation block $HB_i$ in a non-image area AP is thus rendered smaller than that in an image area AI, and power is saved in the fixing apparatus 200. In a case where in S1001 the heating area $A_i$ is not in a recording material range, the heating area $A_i$ is classified as a non-sheet passing area AN (FIG. 7: S1005). Further, the respective control temperature $TGT_i$ is set to $TGT_i=T_{AN}$ (FIG. 7: S1008). Herein, $T_{AP}$ is a non-sheet passing area temperature. Through setting of the non-sheet passing area temperature $T_{AP}$ to a temperature higher than the non-image area temperature $T_{AP}$, the heat generation amount in a heat generation block $HB_i$ at a non-sheet passing area AN is rendered thus larger than that in a non-image area AP, to maintain the concave crown shape of the pressure roller 208.

Figure 8A:
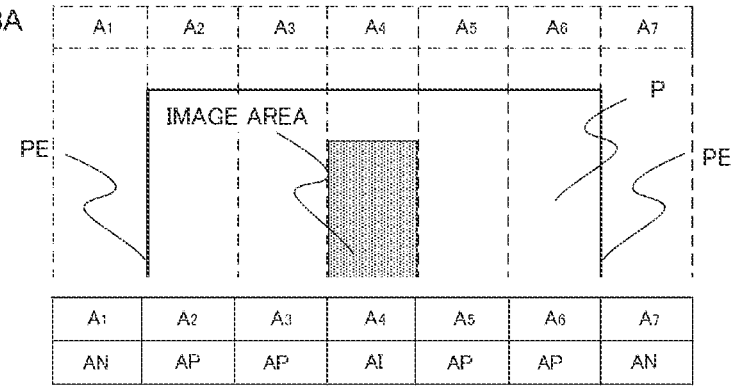
FIGS. 8A to 8D are a plurality of concrete examples of classification of heating areas in the present invention.
Figure 8B:
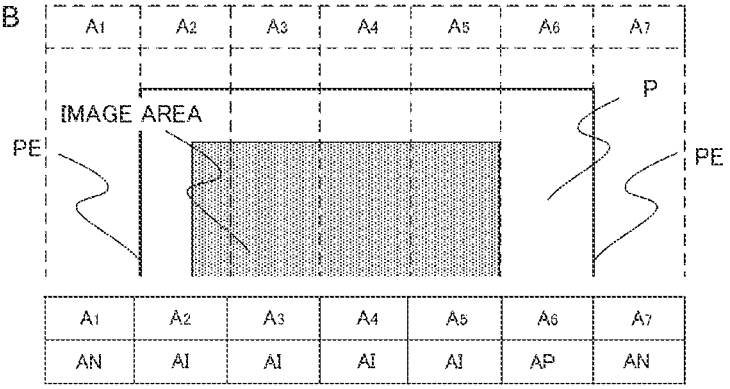
Figure 8C:
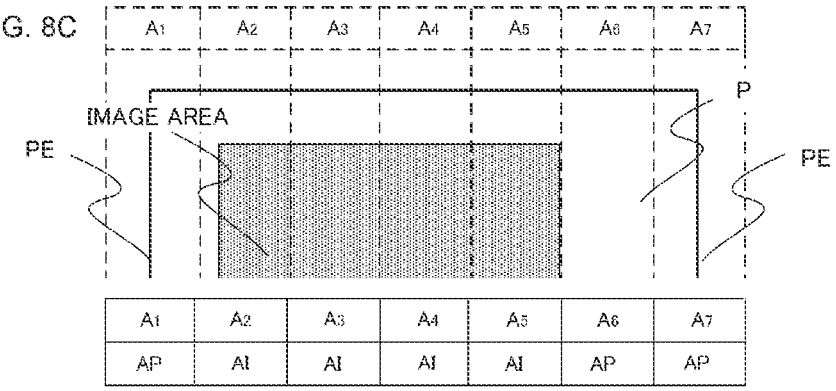
Figure 8D:
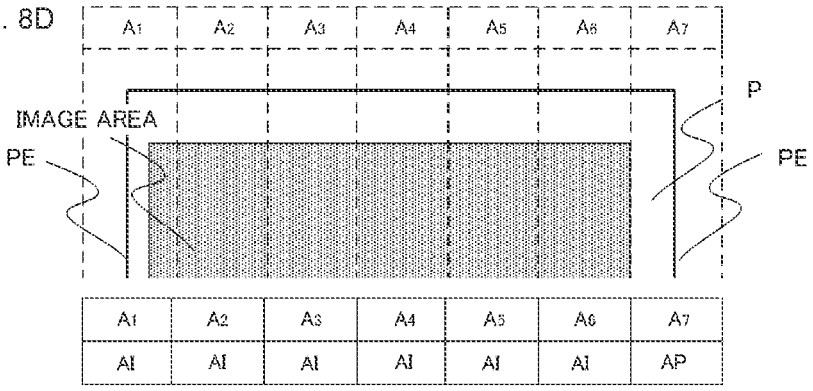

FIGS. 8A to 8D illustrate various classification patterns of the heating areas $A_i$ (i=1 to 7). In FIG. 8A, the heating area $A_4$ is classified as an image area AI, the heating areas $A_2$, $A_3$, $A_5$, $A_6$ are each classified as a non-image area AP, and the heating areas $A_1$, $A_7$ are classified as a non-sheet passing area AN. In FIG. 8B, the heating areas $A_2$, $A_3$, $A_4$, $A_5$ are classified as an image area AI, the heating area $A_6$ is classified as a non-image area AP, and the heating areas $A_1$, $A_7$ are each classified as a non-sheet passing area AN. In a case where there is an image area even in part of a heating area, as in the heating area $A_2$, that heating area is regarded as an image area AI. In FIG. 8C, the heating areas $A_2$, $A_3$, $A_4$, $A_5$ are classified as an image area AI, and the heating areas $A_1$, $A_6$, $A_7$ are each classified as anon-image area AP. In a case where there is a non-sheet passing area even in part of a heating area, as in heating areas $A_1$, $A_7$, and that heating area is not an image area, then the heating area is regarded as a non-image area AP. In FIG. 8D, the heating areas $A_1$, $A_2$, $A_3$, $A_4$, $A_5$, $A_6$ are classified as an image area AI, and the heating area $A_7$ is classified as a non-image area AP. When there is an image area even in part of a heating area, as in the heating area $A_1$, that heating area is regarded as an image area AI.

7. Details of the Heater Control Method

An explanation follows next on a relationship between the image area temperature $T_{AI}$, the non-image area temperature $T_{AP}$ and the non-sheet passing area temperature $T_{AN}$, expounded in the previous section, and the concave crown amount of the pressure roller 208. In the case of a recording material P conforming to the pattern of FIG. 8A (sheet width 155 mm, sheet length 297 mm, image width 31 mm, basis weight 60 g/m$^2$), each heating area is classified as follows on the basis of the image information and the recording material information. Specifically, the heating area $A_4$ is classified as an image area AI, the heating areas $A_2$, $A_3$, $A_5$, $A_6$ are classified as a non-image area AP, and the heating areas $A_1$, $A_7$ are each classified as a non-sheet passing area AN.

Figure 9:
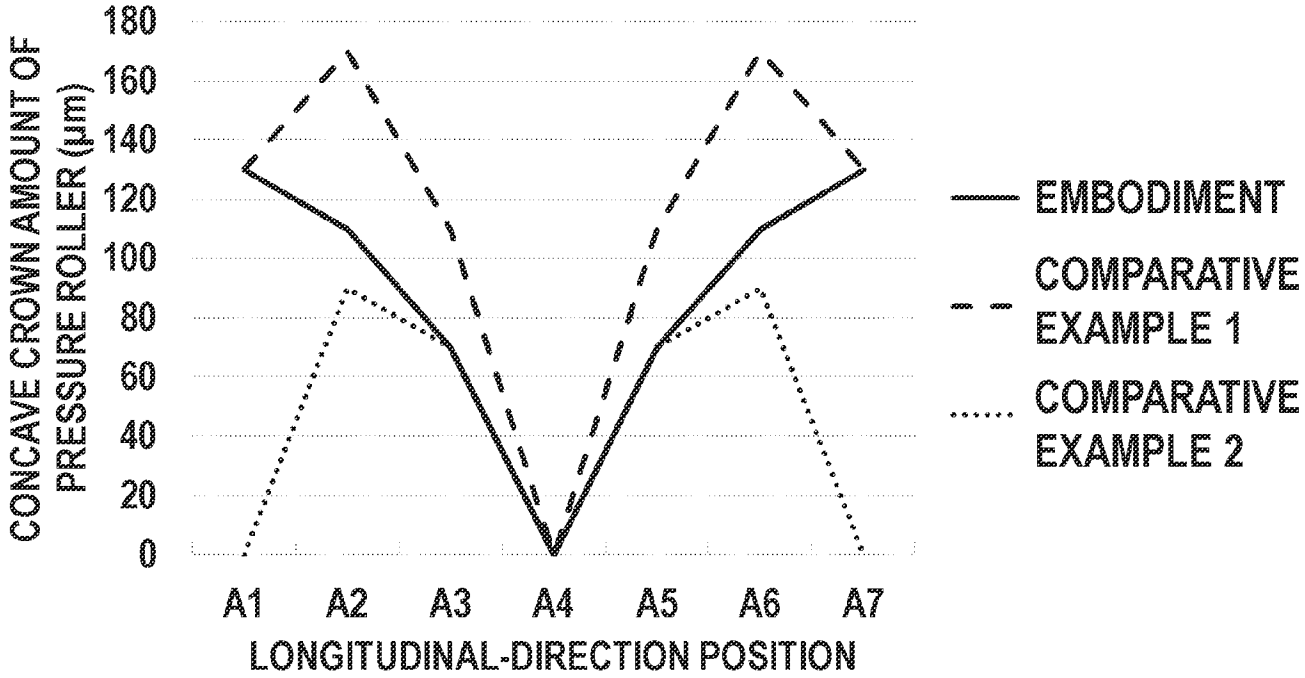
FIG. 9 is a concave crown amount of a pressure roller in Embodiment 1 and comparative examples.

Table 1 illustrates the control temperature of each heating area of the present embodiment, and the control temperature in comparative examples. Further, FIG. 9 illustrates a center difference in outer diameter, as the concave crown amount of the pressure roller 208 when set to this control temperature. In FIG. 9 the solid line is the setting in Embodiment 1, the dashed line is the setting in Comparative example 1, and the dotted line is the setting in Comparative example 2. The higher the non-image area temperature $T_{AP}$, the larger is the concave crown amount of the pressure roller 208, as in Comparative example 1, and the effect for suppressing wrinkles in the recording material P is more pronounced; however, power consumption of the fixing apparatus 200 is conversely higher. By contrast, the lower the of the non-image area temperature $T_{AP}$, as in Comparative example 2, the smaller is the power consumption of the fixing apparatus 200. However, also the concave crown amount of the pressure roller 208 is smaller, and hence the effect of suppressing wrinkles in the recording material P is weaker.

It has been experimentally found that in the configuration of the present embodiment wrinkles occur in the recording material P when the concave crown amount of the pressure roller 208 is less than 100 μm. In the case of Comparative example 2, the concave crown amount in $A_2$ and $A_6$, which are the edges for the sheet passing area of the recording material P, is smaller than 100 μm, and wrinkles occur in the recording material P. In the case of the setting of Comparative example 1, by contrast, the concave crown amount in $A_2$ and $A_6$, which are the edges of the sheet passing area of the recording material P, is 100 μm or larger, and no wrinkles occur in the recording material P, although the power consumption of the fixing apparatus 200 does increase. In the present embodiment both wrinkle suppression in the recording material P and power savings are achieved by focusing, in the light of the above considerations, on the non-sheet passing area temperature $T_{AN}$. Specifically, as shown in table 1, the non-sheet passing area temperature $T_{AN}$ is set to 260° C., which is higher than the image area temperature $T_{AI}$, while the non-image area temperature $T_{AP}$ is set to 100° C. By virtue of such a temperature control, the concave crown amount of the pressure roller 208 is that of the solid line of FIG. 9, and the concave crown amount in $A_2$ and $A_6$, which are the edges of the sheet passing area, is 100 μm or larger, and wrinkles in the recording material P are suppressed. The heating areas $A_1$, $A_7$ set to 260° C. are non-sheet passing areas, and accordingly the heat from the heat generation blocks $HB_1$ and $HB_7$ is not robbed by the recording material P, thanks to which power consumption does not increase significantly, and power saving is accordingly preserved.

TABLE 1

Control temperature in Embodiment 1 and Comparative examples 1 and 2

| | $A_1$ AN | $A_2$ AP | $A_3$ AP | $A_4$ AI | $A_5$ AP | $A_6$ AP | $A_7$ AN |
|---|---|---|---|---|---|---|---|
| Embodiment 1 | 260° C. | 100° C. | 100° C. | 250° C. | 100° C. | 100° C. | 260° C. |
| Comparative example 1 | 0° C. | 250° C. | 250° C. | 250° C. | 250° C. | 250° C. | 0° C. |
| Comparative example 2 | 0° C. | 100° C. | 100° C. | 250° C. | 100° C. | 100° C. | 0° C. |

8. Effect of the Invention

As a comparative experiment, 60 prints of the recording material P (sheet width 155 mm, sheet length 297 mm, basis weight 60 g/m$^2$) corresponding to FIG. 8A are run at the control temperatures of Embodiment 1 and Comparative examples 1 and 2 given table 1; the frequency of occurrence of sheet wrinkles at that time is given in table 2. Table 2 reveals that in the configuration of Comparative example 2, wrinkle occurrence in the recording material P was minor in 30 out of 60 prints, whereas in the configuration of Embodiment 1 no wrinkles occurred in the recording material P. In Embodiment 1, the forces mediated by the pressure roller 208 and that elicit stretching of the recording material P from a central region towards the edge portions PE were maintained through heating of the heating areas $A_1$, $A_7$ which are non-sheet passing areas AN; as a result it was possible to suppress the occurrence of wrinkles in the recording material P. Table 2 further sets out the power at the time of sheet passage in a comparison versus Comparative example 1. Similarly to Embodiment 1, wrinkles did not occur in the recording material P in Comparative example 1; however, power was 7% lower in Embodiment 1. The reason for this is the low temperature of the heating areas $A_2$, $A_3$, $A_5$, $A_6$, which are non-image areas AP. The above comparison revealed that setting the non-sheet passing area temperature to be higher than the non-image area temperature, which is a feature of the present embodiment, elicits the effect of both suppressing wrinkles in the recording material, and saving power.

TABLE 2

| Wrinkle occurrence frequency and power saving in Embodiment 1 and Comparative examples 1 and 2 | | |
|---|---|---|
| | Wrinkle occurrence frequency of recording material P | Power saving relative to Comparative example 1 |
| Embodiment 1 | 0/60 | −7% |
| Comparative example 1 | 0/60 | 0% |
| Comparative example 2 | 30/60 | −10% |

Embodiment 2

An instance of the present embodiment will be explained next in which recording material P (sheet width 155 mm, sheet length 297 mm, image width 93 mm, basis weight 60 g/m$^2$) was run that conformed to the pattern of FIGS. 6A and 6B. Table 3 sets out the control temperature of each heating area in the present embodiment. In the comparative examples, the non-sheet passing area temperature $T_{AN}$ was modified by ±20° C. relative to that in the embodiment, while all the non-sheet passing area temperatures were set to be higher than the non-image area temperatures.

TABLE 3

| Control temperature in Embodiment 2 and Comparative examples 3 and 4 | | | | | | | |
|---|---|---|---|---|---|---|---|
| | $A_1$ AN | $A_2$ AP | $A_3$ AI | $A_4$ AI | $A_5$ AI | $A_6$ AP | $A_7$ AN |
| Embodiment 2 | 240° C. | 100° C. | 250° C. | 250° C. | 250° C. | 100° C. | 240° C. |
| Comparative example 3 | 260° C. | 100° C. | 250° C. | 250° C. | 250° C. | 100° C. | 260° C. |
| Comparative exampie 4 | 220° C. | 100° C. | 250° C. | 250° C. | 250° C. | 100° C. | 220° C. |

Table 4 illustrates the frequency of sheet wrinkles upon running of 60 prints of recording material P (sheet width 155 mm, sheet length 297 mm, image width 93 mm, basis weight 60 g/m$^2$).

TABLE 4

| Frequency of wrinkles and power saving in Embodiment 2 and Comparative examples 3 and 4 | | |
|---|---|---|
| | Wrinkle occurrence frequency of recording material P | Power saving relative to Comparative example 1 |
| Embodiment 2 | 0/60 | −2% |
| Comparative example 3 | 0/60 | 0% |
| Comparative example 4 | 5/60 | −4% |

In the present embodiment the non-sheet passing area temperature $T_{AN}$ was set to 240° C., which is 20° C. lower than that in Embodiment 1 and Comparative example 3; however, no wrinkles occurred in the recording material P. That is because in the present embodiment the image area AI is wider, and the non-image area AP is narrower, than in the case of Embodiment 1, and accordingly the concave crown amount of the pressure roller 208 was readily maintained. In the setting of Comparative example 4 in which the non-sheet passing area temperature $T_{AN}$ was further lowered by 20° C. low, however, the power decreased but the recording material P exhibited slight wrinkling in 5 out of the 60 prints. This revealed that the non-sheet passing area temperature $T_{AN}$ needs to be set in accordance with the image area and the non-image area, in order to suppress the occurrence of wrinkles and maximize power saving. To suppress thus the occurrence of wrinkles and maximize power saving, it is preferable to modify the non-sheet passing area temperature $T_{AN}$ as appropriate depending on other sheet passing conditions. The non-sheet passing area temperature $T_{AN}$ may be lowered in a case for instance where a recording material P is run that is of large basis weight and in which wrinkles are thus not prone to occur; conversely, the non-sheet passing area temperature $T_{AN}$ may be raised for instance in cases where wrinkles are likely to occur, such as in high-humidity environments. The non-sheet passing area temperature $T_{AN}$ may be modified in accordance with the cumulative usage status of the pressure roller 208 and the sheet passing interval of the recording material P.

In the present embodiment, thus, the need has been explained of properly setting the non-sheet passing area temperature $T_{AN}$ in accordance with sheet passing conditions, for the purpose of maximizing wrinkle suppression in the recording material and maximize power saving.

Embodiment 3

An instance of the present embodiment will be explained next in which a recording material P (sheet width 155 mm, sheet length 297 mm, image width 108 mm, basis weight 60 g/m$^2$) was run that conformed to the pattern of FIG. 8B. Table 5 sets out the control temperature of each heating area of the present embodiment. The image pattern in the present embodiment is identical to that of Embodiment 2 (table 3), except that the heating area $A_2$ is herein an image area AI. Therefore, the control temperature of the heating area $A_2$ was set to 250° C., which is the image area temperature $T_{AI}$, whereas the control temperature of the heating area $A_1$ was set to 220° C.

TABLE 5

| Control temperature in Embodiment 3 | | | | | | | |
|---|---|---|---|---|---|---|---|
| | $A_1$ AN | $A_2$ AI | $A_3$ AI | $A_4$ AI | $A_5$ AI | $A_6$ AP | $A_7$ AN |
| Embodiment 3 | 220° C. | 250° C. | 250° C. | 250° C. | 250° C. | 100° C. | 240° C. |

In Comparative example 4 (table 3), where the control temperature of the heating area $A_1$ was the same as in Embodiment 3, the sheet wrinkle occurrence frequency was 5 out of 60 (table 4). In the present embodiment, by contrast, the sheet wrinkle occurrence frequency upon running of 60 prints of the recording material P (sheet width 155 mm, sheet length 108 mm, image width 93 mm, basis weight 60 g/m$^2$), was 0 out of 60. That is because in Comparative example 4 the heating area $A_2$ was a non-image area AP, whereas in the present embodiment the heating area $A_2$ was an image area AI. Specifically, the above result derives from the fact that the image area temperature $T_{AI}$ is high, of 250° C., and accordingly the concave crown of the pressure roller 208 can be readily maintained, even if the temperature of the adjacent heating area $A_1$ is low, of 220° C.

Table 6 sets out the surface temperature of the fixing film 202 at this time. The surface temperature of the fixing film 202 was measured from the exterior, using a contact-less temperature detecting device.

TABLE 6

| Fixing film surface temperature in Embodiment 3 | | | | | | | |
|---|---|---|---|---|---|---|---|
| | $A_1$ AN | $A_2$ AI | $A_3$ AI | $A_4$ AI | $A_5$ AI | $A_6$ AP | $A_7$ AN |
| Fixing film temperature | 220° C. | 250° C. | 250° C. | 250° C. | 250° C. | 100° C. | 240° C. |

Table 6 reveals that the fixing film temperature in the heating areas $A_1$ and $A_7$, which are non-sheet passing areas of the recording material P, is higher, by 20° C. or more, than the fixing film temperature of the heating areas $A_2$, $A_3$, $A_4$, $A_5$, $A_6$ which are sheet passing areas of the recording material P. It was found that the pressure roller 208 is successfully crowned concavely by high temperature of the end portions of the fixing film 202, since these act also on the pressure roller 208 by coming in direct face-to-face contact therewith. The heating area $A_1$ and the heating area $A_7$ have the same fixing film temperature. This indicates that the magnitudes of thermal expansion at the end portions of the pressure roller 208 are equalized. It was found that, as a result, the forces that stretch the recording material P from the central region towards the edge portions PE also act evenly on the left and the right, which translates into suppression of wrinkles. On the other hand, as explained in Embodiments 1 and 2, in the non-sheet passing areas of the heating areas $A_1$ and $A_7$ the heat from the heat generation blocks is not robbed by the recording material P, and accordingly power savings can be maintained, without incurring in significant increases of power consumption.

As explained above, in the present embodiment an effect of suppressing wrinkles in a recording material is elicited through control so that the temperature of a non-sheet passing area of a recording material in a fixing film is higher than the temperature within the sheet passing area of the recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-217256, filed on Dec. 25, 2020, which is hereby incorporated by reference herein in its entirety.

What is claimed is:

1. An image heating device, comprising:

a heating member provided with a heater having a plurality of heating elements juxtaposed in a direction perpendicular to a conveyance direction of a recording material;

a roller that forms a nip portion by pressing against the heating member and that rotates, such that the circumference of the roller increases from a central portion towards ends portions, in a direction perpendicular to the conveyance direction; and a control portion that controls individually the power supplied to the plurality of heating elements;

wherein the image heating device heats up an image formed on the recording material, with heat from the heater, wherein the control portion sets a control target temperature, being set in order to supply power to a heating element corresponding to a non-sheet passing area through which the recording material does not pass at the nip portion, from among the plurality of heating elements, to be higher than a lowest control target temperature from among control target temperatures that are set in order to supply power to a heating element corresponding to a sheet passing area through which the recording material passes at the nip portion, and wherein the sheet passing area that corresponds to the heating element for which the lowest control target temperature is set is a non-image area through which passes an area in which no image is formed on the recording material.

2. The image heating device of claim 1, wherein the sheet passing area that corresponds to the heating element for which the lowest control target temperature is set is the a sheet passing area adjacent to the non-sheet passing area.

3. The image heating device of claim 1, wherein the heating member has a tubular film on the inward side of which the heater is disposed, the nip portion is formed by the heater and the roller across the film, and the image on the recording material is heated via the film.

4. An image forming apparatus, comprising:

an image forming section in which an image is formed on a recording material; and a fixing portion that fixes, to the recording material, the image formed on the recording material, the fixing portion having:

a heating member provided with a heater having a plurality of heating elements juxtaposed in a direction perpendicular to a conveyance direction of a recording material;

a roller that forms a nip portion by pressing against the heating member and that rotates, such that the circumference of the roller increases from a central portion towards ends portions, in a direction perpendicular to the conveyance direction; and a control portion that controls individually the power supplied to the plurality of heating elements;

wherein the fixing portion heats up an image formed on the recording material, with heat from the heater, wherein the control portion sets a control target temperature, being set in order to supply power to a heating element corresponding to a non-sheet passing area through which the recording material does not pass at the nip portion, from among the plurality of heating elements, to be higher than a lowest control target temperature from among control target temperatures that are set in order to supply power to a heating element corresponding to a sheet passing area through which the recording material passes at the nip portion, and wherein the sheet passing area that corresponds to the heating element for which the lowest control target temperature is set is a non-image area through which passes an area in which no image is formed on the recording material.

5. An image heating device for heating an image formed on a recording material, comprising:

a tubular film configured to contact the recording material;

a heater provided in an inner space of the film, the heater includes a substrate and a plurality of heating elements formed on the substrate and arranged in a direction perpendicular to a conveyance direction of the recording material;

a roller configured to contact an outer surface of the film and forms a nip portion in cooperation with heater through the film, and a control portion configured to independently control power supplied to the plurality of heating elements so that each of the plurality of heating elements is maintained at a control target temperature;

wherein the recording material is heated by the heat of the heater while being conveyed at the nip portion, wherein, with respect to the direction perpendicular to the conveyance direction, a diameter of the roller increases from a central portion of the roller towards ends portions of the roller, wherein the control portion sets the control target temperature of a heating element corresponding to an image area where an image is formed among the plurality of the heating elements to temperature $T_{AI}$, sets the control target temperature of a heating element corresponding to a non-image area where an image is not formed on the recording material among the plurality of the heating elements to temperature $T_{AP}$, and sets the control target temperature of a heating element corresponding to a non-sheet passing area through which the recording material does not pass at the nip portion among the plurality of the heating elements to temperature $T_{AN}$, and wherein the temperature $T_{AP}$ is lower than the temperature $T_{AI}$, and the temperature $T_{AN}$ is higher than the temperature $T_{AP}$.

6. The image heating device of claim 5, wherein the control portion sets the temperature $T_{AN}$ higher than the temperature $T_{AI}$ in a first case, and sets the temperature $T_{AN}$ lower than the temperature $T_{AI}$ in a second case, and wherein with respect to the direction perpendicular to the conveyance direction, the image area of the second case is wider than that of the first case.

7. The image heating device of claim 5, wherein the control portion sets the temperature $T_{AN}$ in accordance with a type of the recording material.

8. The image heating device of claim 5, wherein the control portion sets the temperature $T_{AN}$ in accordance with a humidity of environment.

9. The image heating device of claim 5, wherein the control portion sets the temperature $T_{AN}$ in accordance with a cumulative usage of the roller.

10. The image heating device of claim 5, wherein the control portion sets the temperature $T_{AN}$ in accordance with a sheet passing interval of a plurality of the recording materials.

* * * * *